US007189140B1

(12) United States Patent
Shugrue et al.

(10) Patent No.: US 7,189,140 B1
(45) Date of Patent: Mar. 13, 2007

(54) METHODS USING EDDY CURRENT FOR CALIBRATING A CMP TOOL

(75) Inventors: John Shugrue, Phoenix, AZ (US); Nikolay Korovin, deceased, late of Phoenix, AZ (US); by Tatyana Korovina, legal representative, Phoenix, AZ (US); Robert J. Stoya, Cave Creek, AZ (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 11/270,125

(22) Filed: Nov. 8, 2005
(Under 37 CFR 1.47)

(51) Int. Cl.
*B24B 49/18* (2006.01)

(52) U.S. Cl. ..... 451/5; 451/8

(58) Field of Classification Search ..... 451/5, 451/8, 9, 10, 288, 287
See application file for complete search history.

(56) References Cited

U.S. PATENT DOCUMENTS 6,966,816 B2 * 11/2005 Swedek et al. ..... 451/5
2002/0164925 A1 * 11/2002 Swedek et al. ..... 451/5

* cited by examiner

*Primary Examiner*—Robert A. Rose
(74) *Attorney, Agent, or Firm*—Ingrassia, Fisher & Lorenz, P.C.

(57) ABSTRACT

Methods and apparatus are provided for calibrating a chemical mechanical polishing ("CMP") tool having a polishing station with a platen, an eddy current probe disposed within the platen, a polishing pad coupled to the platen, and a metal element disposed within the polishing station and configured to be selectively moved proximate the polishing pad. The method includes the steps of determining a thickness measurement of the polishing pad and adjusting at least one tool parameter based, in part, upon the determined thickness measurement of the polishing pad.

20 Claims, 3 Drawing Sheets

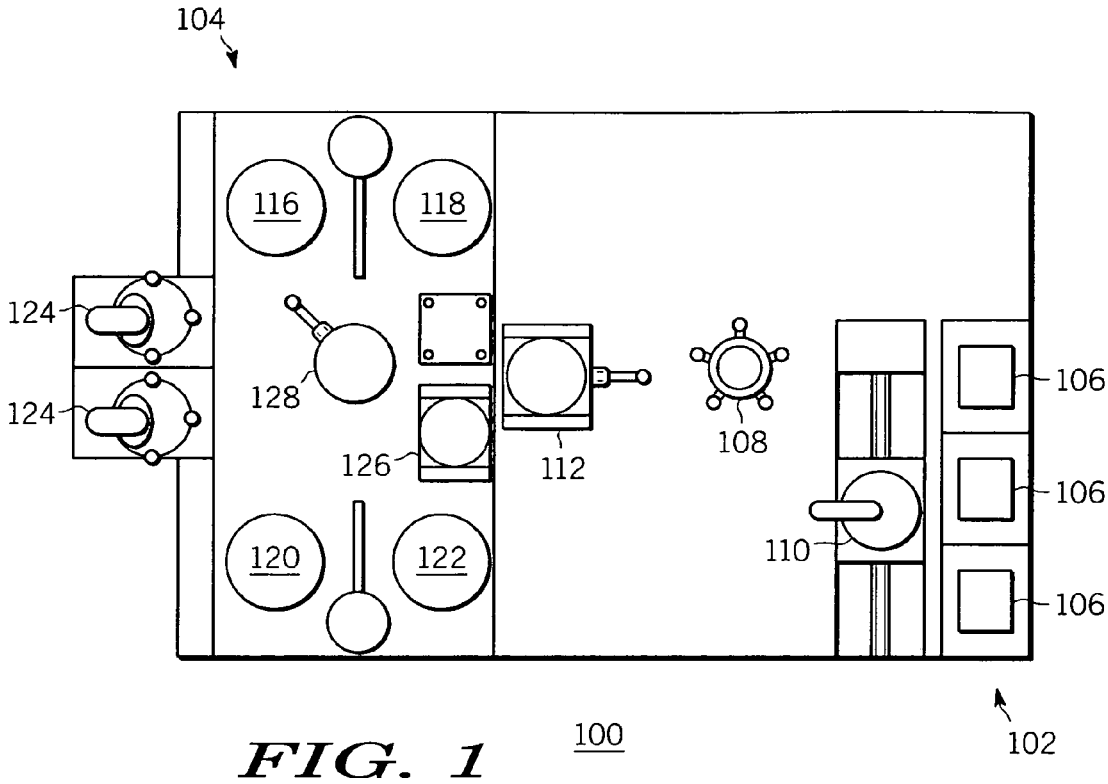
FIG. 1
FIG. 2
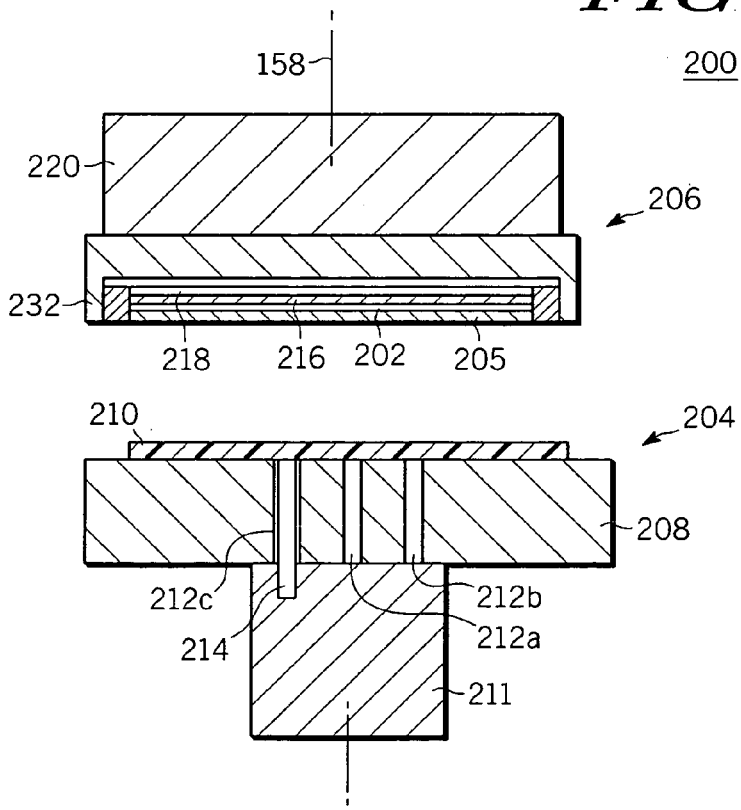

300

400

500

METHODS USING EDDY CURRENT FOR CALIBRATING A CMP TOOL

FIELD OF THE INVENTION

This invention relates generally to methods for calibrating a chemical mechanical polishing ("CMP") tool, and more particularly, using eddy current measurements to calibrate a CMP tool.

BACKGROUND OF THE INVENTION

Integrated circuits are manufactured from workpieces that are typically created by growing an elongated cylinder or boule of single crystal silicon and slicing the individual workpieces from the cylinder. Slicing may cause one or both faces of the workpiece to be somewhat rough. However, at least the front face of the workpiece on which integrated circuitry is to be constructed should be substantially flat in order to facilitate reliable semiconductor junctions formed from subsequent layers of material that are applied to the workpiece. Thus, chemical-mechanical polishing (CMP) is performed on each workpiece to remove projections and other imperfections to create a smooth planar surface. Once the workpiece surface is planarized, composite thin film layers comprising metals for conductors or oxides for insulators then may be deposited over the workpiece. These layers preferably have a uniform thickness for joining to the semiconductor workpieces or to other composite thin film layers. CMP may be employed to planarize the thin film layers.

Typically, a CMP assembly includes a workpiece carrier connected to a shaft. The shaft may be connected to a transporter that moves the carrier between a load or unload station and a position adjacent to a polishing pad. One side of the polishing pad has a polishing surface thereon, and an opposite side is mounted to a rigid platen. Pressure is exerted on a workpiece back surface by the carrier in order to press a workpiece front surface against the polishing pad. Polishing fluid is introduced onto the polishing surface while the workpiece and/or polishing pad are moved in relation to each other by means of motors connected to the shaft and/or platen in order to remove material from the workpiece front surface. After each polishing operation, contaminants, such as removed workpiece material, may be deposited on the polishing pad. Thus, the polishing pad is swept with a conditioning bar to remove the contaminants.

Ideally, tool parameters of the CMP assembly, such as down force pressure exerted by the polishing pad against the workpiece, and/or down force pressure exerted by the conditioning bar against the polishing pad, are set at values that will yield high quality workpieces. However, because some of the tool components, in particular, consumable components such as polishing pads and conditioning bars, become worn with increased use, the tool parameter values may need to be adjusted from time to time. Typically, these adjustments are based upon the number of workpiece operations that have been performed using a particular consumable component.

Although the above-mentioned tool parameter adjustment method is generally effective, it may suffer from drawbacks in certain applications. For example, because the tool parameter adjustments are based, in large part, upon the number of workpieces that are run through the tool, actual tool and workpiece conditions may not be taken into account. This may present issues for a CMP assembly that employs an eddy current probe for determining a metal layer thickness on a workpiece. In particular, the eddy current probe typically generates a magnetic field and then detects a magnetic flux change in the magnetic field when the workpiece metal layer is passed therethrough. The magnetic flux change is influenced, in part, by the distance between the probe and the metal layer. Thus, in cases in which workpieces are disposed on a polishing pad while the eddy current probe obtains its measurement, the diminishing thickness of the polishing pad may cause each workpiece to become increasingly closer to the probe. As a result, the measured metal layer thickness of the workpiece may not be as accurate as desired. Another consequence of using number of operations for adjusting tool parameters may be that some of the consumable components may not be used to their optimal useful life.

Accordingly, it is desirable to have a tool that not only yields high quality workpieces, but also accurately optimizes tool parameters. In addition, it is desirable to have a tool that is capable of optimizing the useful life of its consumable components. Moreover, it is desirable for the tool to indicate an accurate measurement of an amount of metal deposited on a workpiece. Furthermore, other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements, and FIG. 1 is a top cutaway view of an exemplary CMP tool;

FIG. 2 is side view of an exemplary polishing station that may be implemented into the exemplary CMP tool of FIG. 1;

DETAILED DESCRIPTION OF THE INVENTION

Figure 3:
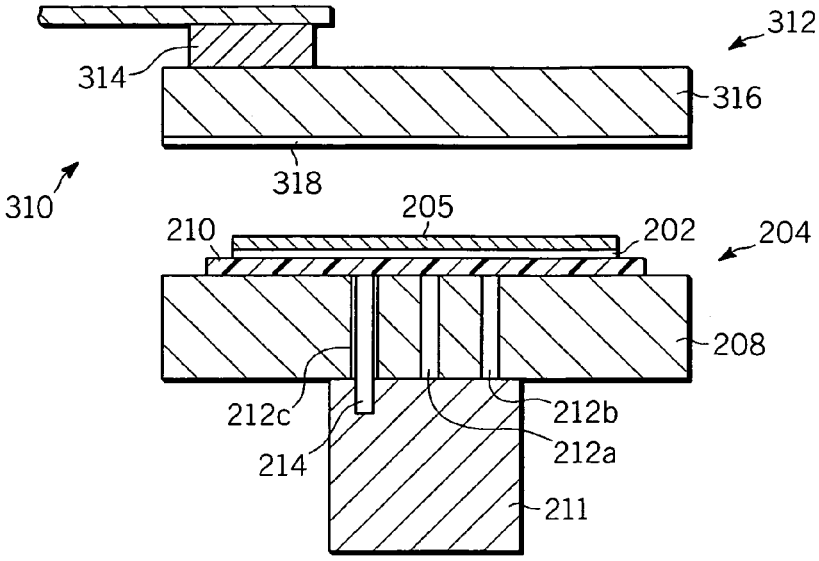
FIG. 3 is side view of another exemplary polishing station that may be implemented into the exemplary CMP tool of FIG. 1.

The following detailed description of the invention is merely exemplary in nature and is not intended to limit the invention or the application and uses of the invention. Furthermore, there is no intention to be bound by any theory presented in the preceding background of the invention or the following detailed description of the invention.

The drawing figures are intended to illustrate the general manner of employing the inventive method and composition in an apparatus and are not necessarily to scale. In the description and in the claims, the terms such as up, down, downward, inward, upper, lower, top, bottom, and the like may be used for descriptive purposes. However, it is understood that the embodiments of the invention described herein are capable of operation in other orientations than as shown, and the terms so used are only for the purpose of describing relative positions and are interchangeable under appropriate circumstances. The term "chemical mechanical planarization" is also often referred to in the industry as "chemical mechanical polishing," and it is intended to encompass herein both terms by the use of "chemical mechanical planarization" and to represent each by the acronym "CMP." For purposes of illustration only, the invention will be described as it applies to a CMP apparatus and to a CMP process and specifically as it applies to the CMP processing of a semiconductor wafer. It is not intended, however, that the invention be limited to these illustrative embodiments; instead, the invention is applicable to a variety of processing apparatus and to the processing and handling of many types of workpieces.

FIG. 1 schematically illustrates an exemplary embodiment of a CMP apparatus 100 according to the present invention. CMP apparatus 100 generally includes at least a workpiece load/unload station 102 and a multi-station polishing system 104. Additionally, CMP apparatus 100 preferably includes at least one controller (not shown) that is coupled to station 102 and system 104 and is configured to at least operate each according to at least one embodiment of the method of the present invention.

Load/unload station 102 includes at least one cassette 106, an intermediate staging area 108, a dry robot 110, and a wet robot 112. Cassette 106 is configured to include one or more workpieces. When cassette 106 is suitably coupled to the apparatus, dry robot 110 transports a workpiece from cassette 106 to intermediate staging area 108. From staging area 108, the workpiece then may be transported by wet robot 112 to polishing system 104 via stage 126. After polishing, wet robot 112 then may transfer the workpiece to a clean system (not shown) for cleaning and drying, or optionally, any other suitable system, prior to transport back to load/unload station 102.

Polishing system 104 is configured to polish a workpiece that is transferred thereto and may include one or more, preferably four polishing stations 116, 118, 120, and 122, buff station 124, stage 126, and a robot 128 configured to transport the workpiece between the polishing stations 116–122 and the stage 126. Each polishing station 116–122 is configured to operate independently from one another and may be configured to perform specific functions of the CMP process, such as the delivery of CMP slurry to a workpiece. A slurry container (not shown) may be externally or internally associated with polishing system 104 to supply CMP slurry to polishing stations 116–122 through at least one supply channel (not shown). CMP slurry may be supplied to a workpiece via any one of numerous conventionally used methods. For example, slurry can be supplied to a polishing platen for a through-the-pad polishing system, or to a workpiece holder for systems in which the slurry is dispensed on to the workpiece or polishing pad surface.

FIG. 2 illustrates a cross sectional side view of a simplified exemplary polishing station 200. Polishing station 200 is configured to polish a workpiece 202, which may have a metal layer 205, an oxide layer (not illustrated), or both formed thereon. Polishing station 200 may be incorporated as any one, some, or all of the four polishing stations 116, 118, 120, and 122 disposed in CMP apparatus 100 described above. Polishing station 200 includes a lower polishing module 204 and a carrier 206. Lower polishing module 204 includes a platen 208 and polishing pad 210. Platen 208 is configured to serve several purposes, including exerting pressure against workpiece 202 during a polishing operation. In this regard, platen 208 is coupled to a carrier head 211 that provides the pressure to platen 208 and that is configured to move platen 208 in different directions, i.e. linearly, orbitally, or rotationally. Platen 208 may also be configured to provide conduits for receiving polishing fluid and/or other devices. Thus, platen 208 includes a plurality of openings 212*a* and 212*b* formed therethrough. Platen 208 also includes an eddy current probe 214 that is configured to generate a magnetic field and detect changes in the magnetic flux density of the field when a metal object is placed therein. Eddy current probe 214 may be disposed in any suitable portion of polishing station 200, for example, proximate platen 208 or, as shown in FIG. 2, disposed within an opening 212*c* in platen 208. Although one eddy current probe 214 is included in the illustrated embodiment, it will be appreciated that more probes 214 may be employed as well.

As briefly mentioned above, polishing pad 210 polishes workpiece 202 when workpiece 202 is urged against pad 210. Polishing pad 210 may be any type of device conventionally used for polishing workpiece 202, for example, a polishing pad, such as a polyurethane polishing pad available from Rohm and Haas of Philadelphia, Pa. Polishing pad 210 has a predetermined initial thickness and is configured to be used for more than one polishing operation. Polishing pad 210 is removably coupled to platen 208 and, in one exemplary embodiment.

Carrier 206 is configured to receive wafer 202 for polishing and urge wafer 202 against the polishing surface during a polishing process. Carrier 206 applies a vacuum-like force to the back side of wafer 202, retains wafer 202, moves in the direction of polishing pad 210 to place wafer 202 in contact with polishing pad 210, releases the vacuum, and applies a force in the direction of polishing pad 210. In one exemplary embodiment, carrier 206 is configured to cause wafer 202 to move, for example, rotationally, orbitally, or translationally. In this regard, carrier 206 includes a body 220 and a retaining ring 222 which retains wafer 202 during polishing, a resilient film 216, and air bladder 218. Resilient film and air bladder 218 cooperate to provide a cushion when carrier 206 is contacted to wafer 202 and may be configured to provide a controlled pressure to a backside of wafer 202 during a polishing process.

Turning now to FIG. 3, a cross sectional side view of another simplified exemplary polishing station 300 is illustrated. Polishing station 300 is configured to be used in a process for conditioning polishing pad 210. Polishing station 300 includes a lower polishing module 204 that has a platen 208, an eddy current probe 214, and a polishing pad 210. Additionally, polishing station 300 includes a conditioning mechanism 310.

Conditioning mechanism 310 is configured to remove any surface irregularities that may be present on polishing pad 210 after a polishing operation in order to maintain a substantially even polishing pad 210 surface. Conditioning mechanism 310 includes a metallic element 312 coupled to a support arm 314. Metallic element 312 may have any one of numerous configurations. In one example, metallic element 312 is a metal bar that is detachably coupled at one end to support arm 314. The metal bar pivots about its attached end and is capable of sweeping from one section of the polishing pad 210 to another. In another embodiment, metallic element 312 is a disk that is detachably coupled to support arm 314, which is configured to rotate the disk. No matter the particular configuration, metallic element 312 includes a metallic layer 316 and an abrasive layer 318. Metallic layer 316 has a thickness of at least about 0.005 inches and is constructed of a metal or other material that is capable of causing a magnetic flux density change when passed through a magnetic field. Suitable materials include, but are not limited to aluminum, stainless steel, copper, and nickel-plated steel. Abrasive layer 318 is coupled to the metallic layer 316 and is configured to be urged against polishing pad 210 to remove surface irregularities that may be present thereon. In this regard, abrasive layer 318 is constructed of a coarse material, for example, crushed or fine diamonds, or silicon carbide.

Figure 4:
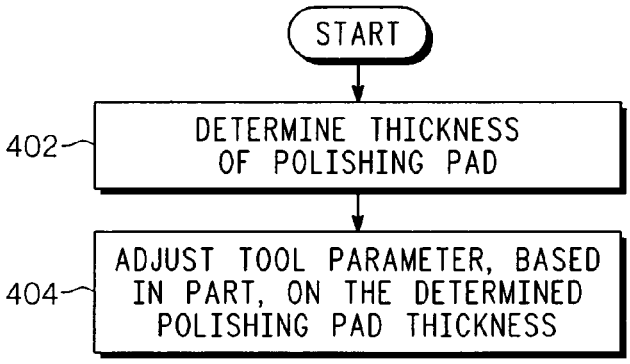
FIG. 4 is a flow chart illustrating an exemplary method of calibrating a parameter of the exemplary CMP tool of FIG. 1.

As previously discussed, the CMP tool parameters are adjusted an amount in order to control the quality of the workpieces. With reference now to FIG. 4, an exemplary method for determining the amount of adjusting a tool parameter will now be discussed. The overall process (400) will first be described generally. It should be understood that the parenthetical references in the following description correspond to the reference numerals associated with the flowchart blocks shown in FIG. 4. First, a thickness of the polishing pad 210 is determined (402). Then, a desired tool parameter is adjusted, based at least in part, on the determined thickness of polishing pad 210 (404). Adjustable tool parameters include, but are not limited to, the number of sweeps or rotations performed on the polishing pad 210 by the conditioning mechanism 310 and/or the down force pressure of the conditioning mechanism 310 on the polishing pad 210, and/or the newness of the polishing pad 210, and/or the newness of the conditioning mechanism 310. This series of steps may be repeated for each workpiece process so that each workpiece will have customized tool parameters and thus, a customized workpiece process, performed thereon.

Figure 5:
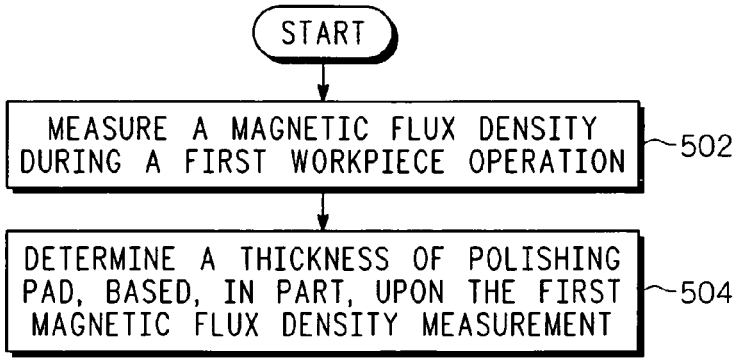
FIG. 5 is a flow chart of an exemplary method of determining a polishing pad thickness that may be used in conjunction with the method depicted in FIG. 4.

The thickness of polishing pad 210 may be determined in any one of a number of manners. In one exemplary process, such as in the process (500) illustrated in FIG. 5, a magnetic flux density is measured during a first workpiece operation (502). Next, the thickness of polishing pad 210 is determined, based, in part, upon the first magnetic flux density measurement (504).

The step of measuring a magnetic flux density (502) includes generating a magnetic field and positioning a metal object within the magnetic field. In one exemplary embodiment, the magnetic field is generated by eddy current probe 214 and the metal object is conditioning mechanism 310; thus, after the magnetic field is generated, conditioning mechanism 310 is moved into contact with polishing pad 210 and through the magnetic field. As conditioning mechanism 310 passes through the magnetic field, a resistance to the magnetic field is created causing the magnetic flux density to change.

Next, the thickness of polishing pad 210 is determined (504). This step (504) includes calculating a distance between eddy current probe 214 and conditioning mechanism 310 using the magnetic flux density change. In particular, the magnetic flux density change is converted into an actual distance value, which may be obtained by entering the magnetic flux density change value into a conventional algorithm used for translating a density change value into an actual distance value. In one exemplary embodiment, a calibration curve is established by taking magnetic flux density measurements from a calibration wafer that is disposed on a variety of polishing pads, each having a different known thickness measurement. The calibration curve is used to interpolate a pad thickness of an actual wafer can then be calculated. It will be appreciated that although the actual distance value is described herein as being the distance between eddy current probe 214 and conditioning mechanism 310, it also represents and is substantially equal to the thickness of polishing pad 210.

The process for determining the thickness of polishing pad 210 (500) can be used in any one of numerous other processes to adjust certain parameters of the CMP tool. For example, workpiece 202 may include a metal layer 205 disposed thereon and process (500) may be used to provide accurate workpiece metal layer 205 measurements from workpiece operation to workpiece operation. First, a thickness of a workpiece metal layer 205 on a first workpiece is determined and process (500) is performed to obtain a first polishing pad 210 thickness measurement. Then, a workpiece operation is performed on a second workpiece and process (500) is performed again to obtain a second polishing pad 210 thickness measurement. Subsequently, a thickness measurement is obtained of a workpiece metal layer 205 of the second workpiece. If the first and second polishing pad thickness measurements are not equal, the second polishing pad thickness measurement is inputted into a compensation algorithm to adjust the thickness measurement of the workpiece metal layer 205 of the second workpiece.

Figure 6:
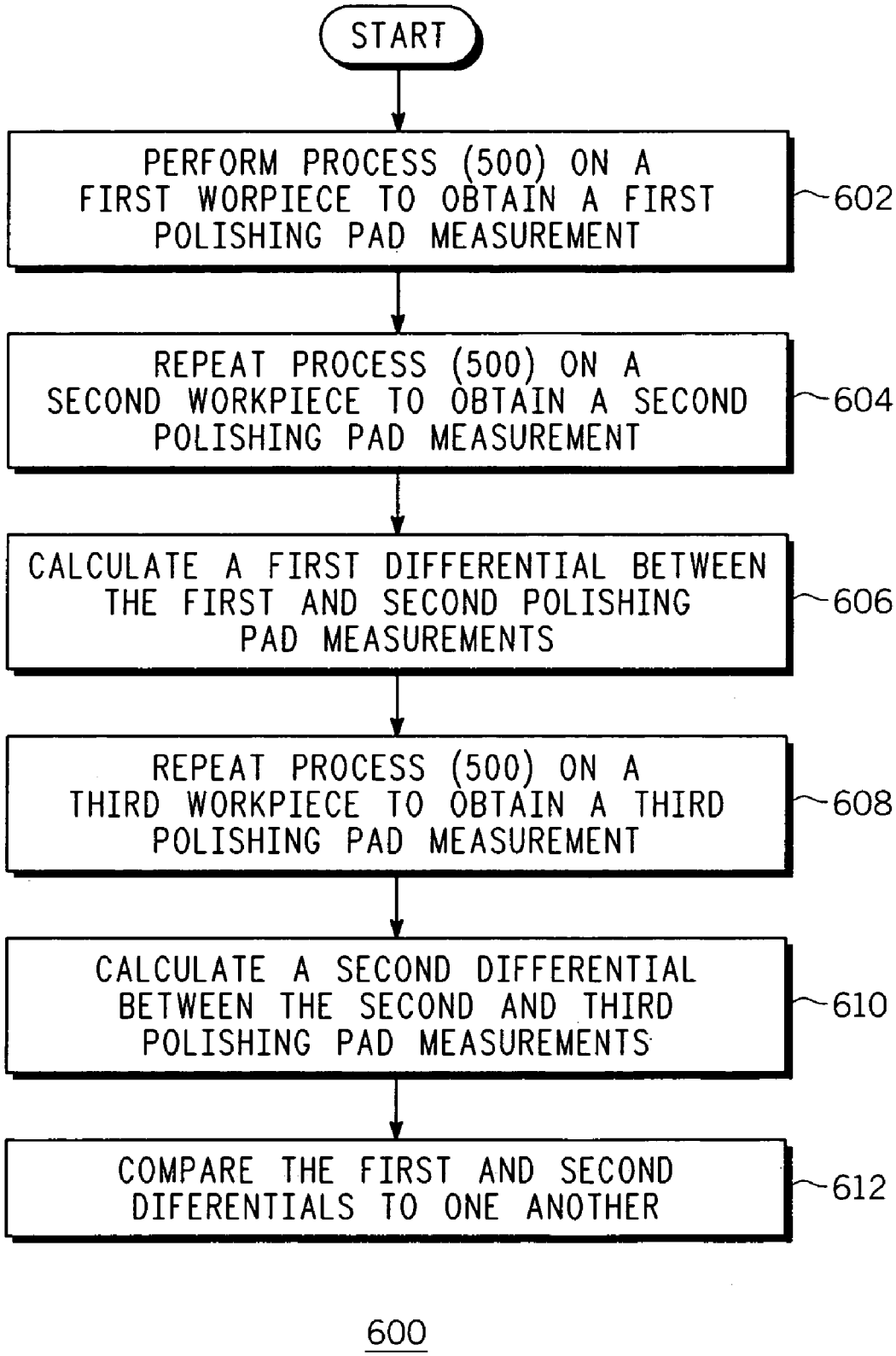
FIG. 6 is a flow chart of an exemplary method of determining a cut rate of a polishing pad that may be used in conjunction with the method depicted in FIG. 4.

In another exemplary embodiment, process (500) can be employed in determining a cut rate for polishing pad 210. The cut rate is the average amount of polishing pad 210 that is removed per conditioning operation performed by conditioning mechanism 310. An exemplary process (600) for determining the cut rate is depicted in FIG. 6. In the first step of process (600), process (500) is performed on a first workpiece to obtain a first polishing pad measurement (602). Then, process (500) is repeated on a second workpiece to obtain a second polishing pad measurement (604). Next, a first differential is calculated between the first and second polishing pad measurements (606). Process (500) is then repeated again on a third workpiece to obtain a third polishing pad measurement (608). A second differential is calculated between the second and third polishing pad measurements (610). Lastly, the first and second differentials are compared with one another (612). Steps (602), (604), and (608) are performed in substantially the same manner as the steps described in process (500) above; however, it will be understood that other suitable manners for determining cut rate may be employed as well.

With regard to step (612), comparing the first and second measurement differentials may include determining whether the differentials are equal or substantially equal to one another. In workpiece operations in which each workpiece is preferably substantially identical to one another, the differentials are preferably equal to one another. However, in cases in which a degree of error is acceptable from one workpiece operation to another workpiece operation, the differentials may be process dependent. In either case, if the values of the differentials unacceptably deviate from one another, the tool parameters are adjusted until acceptable differential values are obtained. Adjustable tool parameters include, but are not limited to, the number of sweeps or rotations performed on the polishing pad 210 by the conditioning mechanism 310 and/or the down force pressure of the conditioning mechanism 310 on the polishing pad 210, and/or the newness of the polishing pad 210, and/or the newness of the conditioning mechanism 310.

In another exemplary embodiment, comparing the first and second measurement differentials includes selecting an acceptable deviation value or acceptable deviation range and determining whether the first and second measurement differentials equal the acceptable deviation value, or alternatively fall within the acceptable deviation range. Selection of the acceptable deviation value or range is dependent, at least in part, on whether each workpiece is preferably substantially identical to one another, in which case the deviation value is preferably substantially 0.0, or whether a degree of error is acceptable from one workpiece operation to another workpiece operation may be process dependent. To determine whether the differentials are acceptable, in one exemplary embodiment, the first and second differentials are subtracted from one another. The result is then compared to the selected acceptable value or range. Just as above, if the result unacceptably deviates from the acceptable value or range, the tool parameters are adjusted until acceptable values or ranges are obtained. It will be appreciated that this embodiment of step (612) may be employed to customize the cut rate of polishing pad 210 as well.

During the life of a consumable component, for example, the conditioning mechanism 310, there is typically a period of use during which tool parameter adjustments become ineffective for obtaining acceptable values or ranges. In such case, the consumable component may need to be replaced. In one exemplary method for determining when component replacement is needed, process (600) is used. First, process (600) is performed. Next, a series of workpiece operations is identified, wherein the measured differentials consistently may not be substantially equal to one another. In one example, the measured differentials consistently decrease from workpiece operation to workpiece operation, indicating that conditioning mechanism 310 is not removing enough material from the polishing pad 210. Once the series is identified, the consumable component is replaced.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for adjusting a tool parameter related to a conditioning mechanism or polishing pad disposed within a chemical mechanical polishing tool, the tool having a polishing station with a platen, an eddy current probe disposed within the platen, the polishing pad coupled to the platen, and the conditioning mechanism disposed within the polishing station and configured to be selectively moved proximate the polishing pad, the method comprising the steps of:

moving the conditioning mechanism proximate the polishing pad;

determining a thickness measurement of the polishing pad based, in part, on a distance between the conditioning mechanism and the polishing pad; and adjusting at least one tool parameter related to the conditioning mechanism or polishing pad based, in part, upon the determined thickness measurement of the polishing pad.

2. The method of claim 1, wherein the step of determining further comprises:

measuring a first magnetic flux density using the eddy current probe and the conditioning mechanism, during a first workpiece operation; and calculating a first distance between the eddy current probe and conditioning mechanism, based, in part, upon the first magnetic flux density measurement.

3. The method of claim 2, wherein the step of measuring a first magnetic flux density further comprises generating a magnetic field and moving the conditioning mechanism into the magnetic field.

4. The method of claim 2, further comprising:

measuring a second magnetic flux density using the eddy current probe and the conditioning mechanism, during a second workpiece operation;

calculating a second distance between the eddy current probe and conditioning mechanism, based, in part, upon the second magnetic flux density measurement; and comparing the first distance and second distance to determine a differential.

5. The method of claim 1, wherein the step of adjusting a tool parameter comprises adjusting the thickness measurement of the polishing pad.

6. The method of claim 1, further comprising:

determining a cut rate, based, in part, upon the thickness measurement of the polishing pad.

7. The method of claim 6, wherein the step of determining a cut rate further comprises:

measuring a first magnetic flux density using the eddy current probe and the conditioning mechanism, during a first workpiece operation;

calculating a first distance between the eddy current probe and conditioning mechanism, based, in part, upon the first magnetic flux density measurement;

measuring a second magnetic flux density using the eddy current probe and the conditioning mechanism, during a second workpiece operation;

calculating a second distance between the eddy current probe and conditioning mechanism, based, in part, upon the second magnetic flux density measurement;

comparing the first distance and second distance to determine a first differential;

measuring a third magnetic flux density using the eddy current probe and the conditioning mechanism, during a third workpiece operation;

calculating a third distance between the eddy current probe and conditioning mechanism, based, in part, upon the third magnetic flux density measurement; and comparing the second distance and third distance to determine a second differential.

8. The method of claim 7, further comprising determining whether the first and second differentials are one of equal or substantially equal to one another.

9. The method of claim 8, wherein the step of adjusting a tool parameter comprises adjusting a tool parameter, if the first and second differentials are not one of equal or substantially equal to one another.

10. The method of claim 7, further comprising determining whether the first and second differentials are one of equal to an acceptable deviation value or within an acceptable deviation range.

11. The method of claim 10, wherein the step of adjusting a tool parameter comprises adjusting a tool parameter, if the first and second differentials are not one of equal to an acceptable deviation value or within an acceptable deviation range.

12. The method of claim 11, wherein the step of adjusting a tool parameter includes replacing a consumable component of the tool.

13. The method of claim 1, wherein the step of adjusting a tool parameter comprises at least one of adjusting a number of sweeps or rotations performed on the polishing pad by the conditioning mechanism, adjusting a down force pressure to be exerted by the conditioning mechanism on the polishing pad, replacing the polishing pad, and replacing the conditioning mechanism.

14. A method for adjusting a tool parameter related to a conditioning mechanism or polishing pad disposed in a chemical mechanical polishing tool, the tool having a polishing station with a platen, an eddy current probe disposed within the platen, the polishing pad coupled to the platen, and the conditioning mechanism disposed within the polishing station and configured to be selectively moved proximate the polishing pad, the method comprising the steps of:

measuring a first magnetic flux density using the eddy current probe and the conditioning mechanism, during a first workpiece operation;

calculating a first distance between the eddy current probe and conditioning mechanism, based, in part, upon the first magnetic flux density measurement;

measuring a second magnetic flux density using the eddy current probe and the conditioning mechanism, during a second workpiece operation;

calculating a second distance between the eddy current probe and conditioning mechanism, based, in part, upon the second magnetic flux density measurement;

comparing the first distance and second distance to determine a differential; and adjusting a tool parameter related to the conditioning mechanism based, in part, upon the differential.

15. The method of claim 14, further comprising:

determining a thickness value of a metal layer on a workpiece by measuring a magnetic flux density of the metal layer on the workpiece; and adjusting the thickness value of the metal layer on the workpiece based, in part upon the determined thickness measurement of the polishing pad to obtain a true thickness value of the metal layer on the workpiece.

16. The method of claim 15, wherein the step of measuring a first magnetic flux density further comprises generating a magnetic field and moving the conditioning mechanism into the magnetic field.

17. A method for determining a cut rate on a chemical mechanical polishing tool having a polishing station with a platen, an eddy current probe disposed within the platen, a polishing pad coupled to the platen, and a metal element disposed within the polishing station and configured to be selectively moved proximate the polishing pad, the method comprising:

measuring a first magnetic flux density using the eddy current probe and the metal element, during a first workpiece operation;

calculating a first distance between the eddy current probe and metal element, based, in part, upon the first magnetic flux density measurement;

measuring a second magnetic flux density using the eddy current probe and the metal element, during a second workpiece operation;

calculating a second distance between the eddy current probe and metal element, based, in part, upon the second magnetic flux density measurement;

comparing the first distance and second distance to determine a first differential;

measuring a third magnetic flux density using the eddy current probe and the metal element, during a third workpiece operation;

calculating a third distance between the eddy current probe and metal element, based, in part, upon the third magnetic flux density measurement; and comparing the second distance and third distance to determine a second differential.

18. The method of claim 17, further comprising determining whether the first and second differentials are one of equal or substantially equal to one another.

19. The method of claim 18, further comprising the step of adjusting a tool parameter, if the first and second differentials are not one of equal or substantially equal to one another.

20. The method of claim 19, further comprising determining whether the first and second differentials are one of equal to an acceptable deviation value or within an acceptable deviation range.

* * * * *